United States Patent [19]

Dougan et al.

[11] 4,448,135

[45] May 15, 1984

[54] INLINE AIR-COAL SEPARATOR

[75] Inventors: Donald R. Dougan, North Canton; Albert D. LaRue, Uniontown, both of Ohio; John J. Wolf, Upper Darby, Pa.

[73] Assignee: The Babcock & Wilcox Company, New Orleans, La.

[21] Appl. No.: 500,016

[22] Filed: Jun. 7, 1983

Related U.S. Application Data

[63] Continuation of Ser. No. 321,011, Nov. 16, 1981, abandoned.

[51] Int. Cl.[3] ..... F23D 1/00

[52] U.S. Cl. ..... 110/263; 110/264; 110/265; 55/461

[58] Field of Search ..... 110/261-265, 110/244; 55/461, 456, 457

[56] References Cited

U.S. PATENT DOCUMENTS

| | | | |
|---|---|---|---|
| 2,489,618 | 11/1949 | Cantin | 55/461 |
| 2,979,000 | 4/1961 | Sifrin et al. | 110/265 |
| 3,115,851 | 12/1963 | Ceely | 110/264 |
| 3,250,236 | 5/1966 | Zelinski | 110/265 |
| 3,528,218 | 9/1970 | Garrett et al. | 55/461 |
| 3,953,184 | 4/1976 | Stockford et al. | 55/461 |
| 4,132,180 | 1/1979 | Fredrick | 110/264 |
| 4,241,673 | 12/1980 | Smith et al. | 110/265 |

*Primary Examiner*—Henry C. Yuen

*Attorney, Agent, or Firm*—Robert J. Edwards; J. Henry Muetterties

[57] ABSTRACT

A coal-air separator to be used in combination with a pulverized coal-fired burner having an elbow section and a wye section. The wye section is flow connected to the outlet of the elbow so that the coal-rich portion is transported through the main fuel conduit to the burner. The coal lean portion is transported through the take-off conduit, the outlet being positioned outside the furnace windbox.

1 Claim, 4 Drawing Figures

INLINE AIR-COAL SEPARATOR

This application is a continuation of application Ser. No. 321,011 filed Nov. 16, 1981, now abandoned.

BACKGROUND OF THE INVENTION

The present invention relates to fuel burners and more particularly to an improved separator, to be used during low load operation of fuel burners in connection with pulverized coal-fired furnaces, which improves low load operation by separating the air entrained pulverized coal into a rich coal stream and a lean coal, moisture-ladened stream.

In view of today's fluctuating electricity demand, electric utilities have chosen to cycle many of their conventional coal-fired steam generator boilers by operating them at full load during peak demand hours and reducing them to low loads during periods of minimum demand. During these low load periods it is customary to burn auxiliary fuels in the boilers.

Auxiliary fuels burned in pulverized coal-fired utility boilers, principally diesel oil and natural gas, have become increasingly expensive while their availability has become uncertain. Government regulations are adding further pressures to reduce auxiliary fuel consumption utilities. However, auxiliary fuel consumption has been increasing because of cycling, low NOx burners and decreasing fuel quality.

Another problem associated with operating a coal-fired burner at low loads results in the fact that the pulverizing mills typically operate with a relatively constant air flow over all load ranges. When furnace load is reduced, the amount of coal pulverized in the mills decrease proportionally while the amount of primary air used to convey the pulverized coal from the mills through the admission assemblies into the furnace remains fairly constant, thereby causing the fuel-air ratio to decrease. When the load on the furnace is reduced to the low levels desired during minimum demand periods, the fuel-air ratio has decreased to the point where the pulverized coal-primary air mixture has become too fuel lean for ignition to stabilize without significant supplemental ignition energy being made available. The coal/air mixture leaving the pulverizer not only has a large amount of excess air but also has a high moisture content. The high moisture laden air and high burner nozzle exit velocities result in poor combustion performance. In order to improve the combustion characteristics of this mixture, some of the excess moisture laden air is separated to create a coal rich and coal lean stream. The amount of air extracted by the separator depends on the type of coal used and the operating conditions.

Another final problem associated with operating a coal-fired burner at low loads is inherent in the properties of the coal to be burned. When burning coals with high surface moisture content such as lignite, it is necessary to dry the coal by adding excess hot air to the pulverizer to remove the moisture from the coal. High moisture content and a large volume of excess air result in poor combustion.

Typically separators have been of the cyclone separator type which are satisfactory for vertical burner applications, U.S. Pat. No. 2,293,737 (Hardgrove). However, most coals are fired horizontally. A horizontal application requires air for transporting the more dense fuel stream to the burner unlike the gravity feed of a vertical cyclone separator. Cyclone separators become impractical for horizontal discharge due to their size and pressure losses.

U.S. Pat. No. 4,274,343 (Kokkinos) discloses a separator used with horizontally fired pulverized coal. Centrifugal force separates the pulverized coal into a high coal concentration portion and a low coal concentration portion as the fuel passes through the elbow. A plate disposed along the longitudinal axis of the coal delivery pipe maintains the concentration of the two portions until each is discharged into the furnace through separate tiltable nozzles.

SUMMARY OF THE INVENTION

The present invention provides a coal-air separator of the type utilizing centrifugal force to effect separation of the coal-air mixture into dense and lean portions.

In accordance with the present invention a coal-air separator comprising an elbow section and a wye section are respectively flow connected downstream to a primary air and pulverized coal delivery pipe. The wye section has a main fuel conduit flow connected downstream of the elbow, a take-off conduit which has an inlet and outlet end, said inlet end is concentrically spaced within the main fuel conduit and said outlet end disposed outside thereof, and a deflector positioned at the inlet end of the take-off conduit.

The air entrained pulverized coal is delivered to the separator through a main fuel delivery pipe. The separator effects separation of the pulverized coal-primary air mixture into a first and a second portion. The first portion having a higher coal/air ratio than the second portion. The rich mixture is delivered directly into the furnace through the burner nozzle via the main fuel conduit. The lean mixture is discharged into the furnace via the take-off conduit through a port located outside the windbox.

DESCRIPTION OF THE PREFERRED EMBODIMENT

Figure 1:
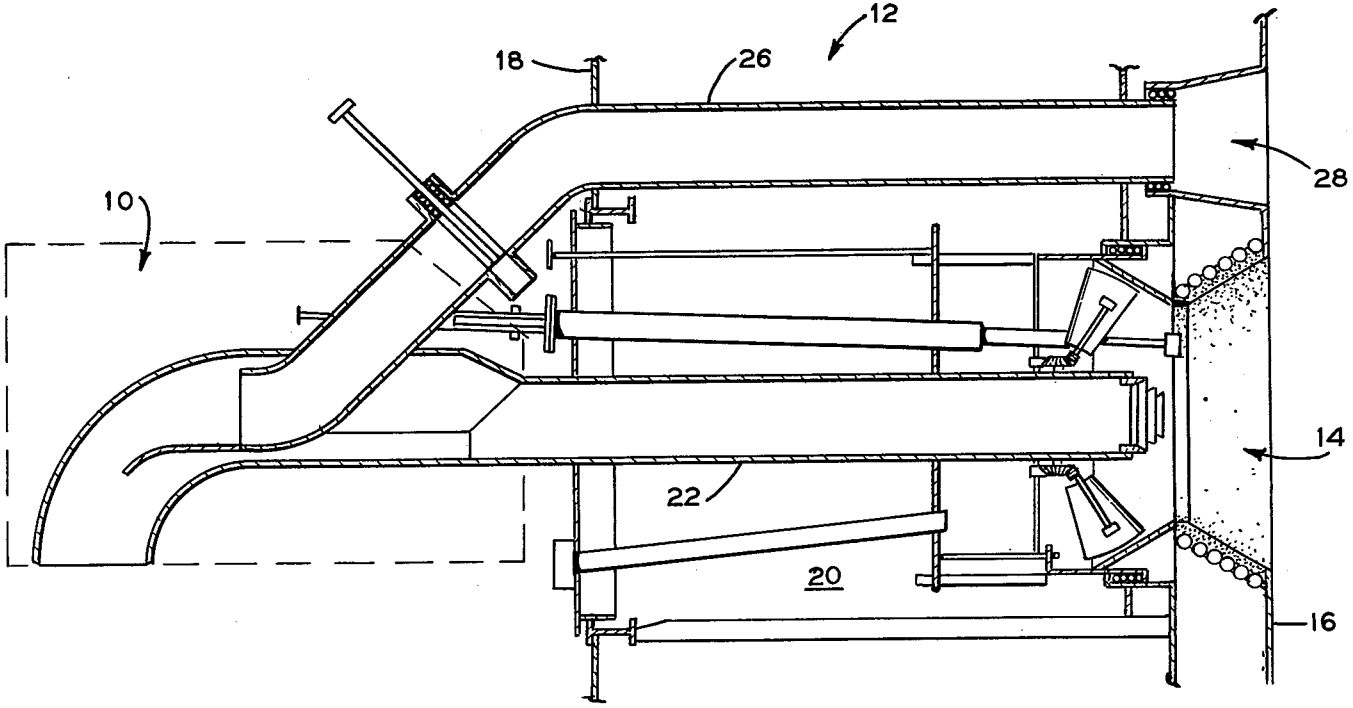
FIG. 1 is an elevational cross-sectional view of a coal-air separator in combination with a pulverized coal burner in accordance with the present invention.

Referring to FIG. 1 there is shown a coal-air separator section 10 in combination with a pulverized coal burner 12 arranged to fire through the burner port 14, the latter being lined by refractory and formed as a frustoconical throat diverging toward the furnace side of wall 16. An outer wall 18 having an access opening, is spaced from furnace wall 16. The space between the burner 12 and the furnace walls, 16 and 18, forms a windbox 20. The burner 12 includes a main nozzle 22 flow connected to the separator section 10 which extends across windbox 20 to a point adjacent the burner port 14 and a second nozzle 26, also flow connected to the separator section 10, which is positioned outside windbox 20 and opens into the furnace at a secondary port 28.

Figure 2:
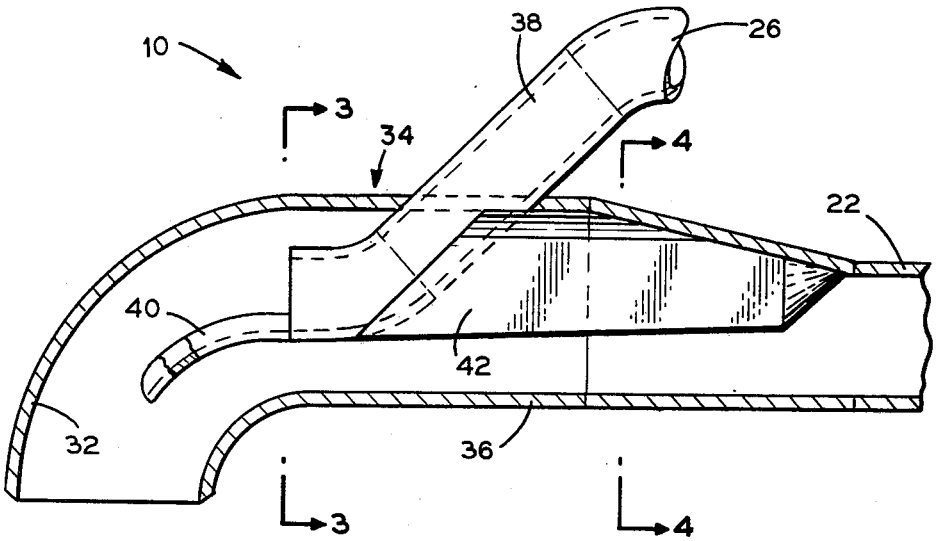
FIG. 2 is an elevational cross-sectional view of a coal-air separator in accordance with the present invention.
Figure 3:
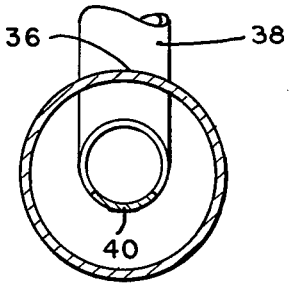
FIG. 3 is an end view taken along line 3—3 of FIG. 2.
Figure 4:
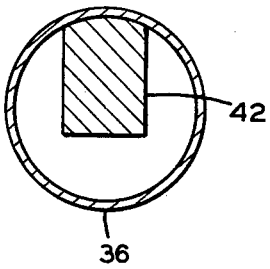
FIG. 4 is a front view taken along line 4—4 of FIG. 2.

Referring to FIGS. 2 to 4 there is shown the coal-air separator 10 flow connected at its inlet end to the fuel delivery pipe 30 and immediately upstream of the burner 12. Separator 10 includes an elbow 32 and a wye section 34. The elbow 32 is connected downstream of the fuel delivery pipe 30 and upstream of the wye section 34. The wye section 34 includes a main fuel conduit 36 and a secondary or take-off fuel conduit 38. The inlet of the take-off conduit 38 is concentially positioned within main fuel conduit 36 and extends into the elbow 32. Attached to the bottom portion of the take-off conduit's inlet end is a deflector 40, which is approximately a one quarter section of, and having the same radius as, the take-off conduit 38. The deflector 40 extends through approximately one half of the elbow 32 and is curved to conform to the radius of curvature of the elbow 32. Take-off conduit 38 is directed out of the main fuel conduit 36 whereupon it is flow connected to the secondary nozzle 26. Within the main fuel conduit 36 and immediately downstream of the take-off conduit's inlet is a fairing 42. Fairing 42 is sized in order to maintain constant flow area thereby reducing pressure losses.

The coal to be burned in the vapor generator is delivered in raw form via fuel delivery pipe 30 from a raw coal storage bunker to a feeder in response to the load demand on the vapor generator in a manner well known in the art. The pulverizer grinds the raw coal to the desired particle size. Pressurized air flowing from the primary air fan sweeps through the pulverizer carrying therewith the ground coal particle for transport through the fuel delivery pipe 30.

As the primary air and pulverized coal mixture enter the elbow 32 of separator 20 a secondary rotating flow is established in the elbow 32. This rotating flow separates the coal by centrifugal force. The pulverized coal tends to concentrate toward the outside radius of elbow 32 and is thereafter drawn off with sufficient air to transport it to the burner 12 through main fuel conduit 36. However, the pulverized coal nearest to the inner radius of elbow 32 is inhibited from being thrown against the outer radius of the elbow 32 by deflector 40. This portion of coal-air joins with the concentrated portion and is transported to the burner 12 through main fuel conduit 36 and discharged into the furnace with the proper amount of secondary air for combustion. A second portion or leaner mixture is taken from the center of the inlet of the main fuel conduit 36, transported through the take-off conduit 38 to be discharged into the furnace through secondary port 28.

While in accordance with the provisions of the statutes there is illustrated and described herein a specific embodiment of the invention, those skilled in the art will understand that changes may be made in the form of the invention covered by the claims, and that certain features of the invention may sometimes be used to advantage without a corresponding use of other features.

The embodiments of the invention in which an exclusive property or privilege is claimed are defined as follows:

1. In combination with a boundary wall of a furnace, a burner wall spaced from the boundary wall to form a windbox therebetween, the boundary wall having first and second ports extending therethrough, the first port being disposed subjacent to the second port, and the windbox communicating with the first port to deliver combustion air thereto, an improved pulverized fuel burner comprising first and second nozzles, the first nozzle being formed of a horizontally-oriented segment defining an outlet, an elbow defining an inlet, and a fairing connection the elbow to the segment, the second nozzle being formed of an upwardly-oriented segment having upper and lower curved end-portions, and a horizontally-oriented segment connected to the upper portion and defining an outlet, the lower portion being disposed within the first nozzle and defining an inlet concentrically spaced with relation to the elbow, an arcuate deflector connected to a lower section of the inlet of the second nozzle, the deflector projecting into the elbow to promote flow of a lean fuel-air mixture through the second nozzle and a rich fuel-air mixture through said first nozzle.

* * * * *